US010088286B2

(12) United States Patent
Parker et al.

(10) Patent No.: US 10,088,286 B2
(45) **Date of Patent: *Oct. 2, 2018**

(54) TARGET ASSIGNMENT PROJECTILE

(71) Applicant: Marsupial Holdings, Inc., Waitsfield, VT (US)

(72) Inventors: William P. Parker, Waitsfield, VT (US); Thomas F. A. Bibby, St. Albans, VT (US)

(73) Assignee: Marsupial Holdings, Inc., Waitsfield, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/584,014

(22) Filed: May 1, 2017

(65) Prior Publication Data

US 2017/0336185 A1 Nov. 23, 2017

Related U.S. Application Data

(62) Division of application No. 10/483,753, filed on Sep. 27, 2004, now Pat. No. 9,638,501.

(Continued)

(51) Int. Cl.

| | |
|---|---|
| ***F42B 10/00*** | (2006.01) |
| ***F42B 12/38*** | (2006.01) |
| ***F42B 12/36*** | (2006.01) |

(52) U.S. Cl.

CPC ..... *F42B 12/382* (2013.01); *F42B 12/365* (2013.01)

(58) Field of Classification Search

CPC ..... F42B 12/365; F42B 12/382

See application file for complete search history.

(56) References Cited

U.S. PATENT DOCUMENTS 4,655,411 A * 4/1987 Franzen ..... F41G 3/04 244/3.11

4,722,282 A * 2/1988 Synofzik ..... F42C 1/14 102/493

(Continued)

*Primary Examiner* — Gabriel J. Klein

(74) *Attorney, Agent, or Firm* — Justin W. McCabe; Dunkiel Saunders Elliott Raubvogel & Hand, PLLC

(57) ABSTRACT

A system for communicating with a projectile in flight toward an intended target includes a barrel-launched projectile and a remote receiver. The barrel-launched projectile includes an ordnance portion, an active communications apparatus and an onboard speed control. The active communications apparatus includes an onboard receiver, an electromagnetic wave reception device, and an active transmitter. The electromagnetic wave reception device includes at least one from the group consisting of an antenna and a photo receptor and is configured to receive an electromagnetic signal. The electromagnetic wave reception device is connected to provide a signal derived from the electromagnetic signal to the onboard receiver to deploy the onboard speed control. The active transmitter is connected and configured for transmitting a signal to the remote receiver during flight and before activation of the speed control. The transmitted signal is directed within a cone angle extending in a direction opposite of the barrel-launched projectile's flight direction. The onboard speed control includes a shaped explosive charge. Deploying the onboard speed control initiates explosion of the shaped explosive charge. The explosion of the shaped explosive charge adjusts velocity of the barrel-launched projectile.

23 Claims, 7 Drawing Sheets

Related U.S. Application Data

(60) Provisional application No. 60/506,333, filed on Sep. 27, 2003.

(56) References Cited

U.S. PATENT DOCUMENTS

| | | | | | |
|---|---|---|---|---|---|
| 4,934,273 | A * | 6/1990 | Endriz | F42B 12/42 | 102/336 |
| 5,841,059 | A * | 11/1998 | Laurend | F42C 13/006 | 102/211 |
| 6,378,437 | B1 * | 4/2002 | Burke, Jr. | F42B 15/01 | 102/293 |
| 6,531,965 | B1 * | 3/2003 | Kaiser | F42B 12/365 | 102/513 |
| 6,880,467 | B1 * | 4/2005 | Knapp | F42B 12/36 | 102/293 |
| 6,978,717 | B1 * | 12/2005 | Hambric | F42B 12/365 | 102/473 |
| 2002/0190155 | A1 * | 12/2002 | Lipeles | A47K 10/32 | 242/598.6 |
| 2004/0066451 | A1 * | 4/2004 | Schroth | F42B 12/365 | 348/144 |
| 2005/0034627 | A1 * | 2/2005 | Manole | F42B 12/382 | 102/513 |

* cited by examiner

TARGET ASSIGNMENT PROJECTILE

RELATED APPLICATIONS

This application is a divisional of U.S. patent application Ser. No. 10/483,753, filed Sep. 27, 2004, which claims priority to U.S. Provisional Patent Application 60/506,333, filed Sep. 27, 2003, both entitled "Target Assignment Projectile".

TECHNICAL FIELD

This disclosure generally relates to projectiles and, more particularly, to communicating projectiles.

BACKGROUND

It is often desirable to remotely monitor people and places. This monitoring activity was traditionally accomplished by planting a "bug", such that the "bug" is a covert microphone or video camera, for example. Unfortunately, this activity requires that a person (e.g., a spy, a soldier, or a detective, for example) enter the place that they wish to monitor so that the "bug" can be planted. Naturally, there are risks associated with such a procedure.

Further, the use of smart munitions (e.g., laser-guided missiles and bombs, for example) have greatly increased the accuracy of munitions. Typically, the target is illuminated (i.e., designated or "painted") using a laser source, and the laser-guided weapon uses that laser light painting the target as a homing beacon. Unfortunately, in order to illuminate a target, a laser must be aimed at and maintained on the target until the missile/bomb strikes the target. Again, this requires one or more soldiers to be in harm's way prior to and during the bombing mission.

SUMMARY OF THE DISCLOSURE

According to an aspect of this disclosure, a projectile includes an ordnance portion configured to impact a target, and a communication apparatus positioned rearward of the ordnance portion. The projectile is configured to rotate about and travel along a longitudinal axis after launch.

One or more of the following features may also be included. The ordnance portion may include a bullet or a grenade. The ordnance portion may be configured to partially penetrate a target such that at least a portion of the communication apparatus is remotely visible. The ordnance portion may be constructed of an energy absorbing material, such as: thermoplastic; or a soft metal. The energy absorbing material may encase a penetration device. The penetration device may be constructed of a material chosen from the group consisting of: a ceramic material (e.g., silicon carbide); a carbon fiber material; and a hard metal (e.g., tungsten). The penetration device may be a threaded penetration device configured to attach the projectile to sheet metal.

One or more deployable fins may extend after leaving a barrel from which the projectile is launched. The projectile may include one or more range-limiting fins. A sabot may encase the projectile at the time the projectile is launched. A way to decrease the impact force also include structures that disrupt airflow around the bullet at a specific range to slow it down or stop it in mid-flight, such as the fins formed by the scalloped regions found on the example of Olin's range limited training ammunition (RLTA), illustrated in FIG. 8. Speed control can be incorporated into a supersonic projectile so the velocity can be reduced rapidly either at impact or when the projectile is close to the target. On-board speed control allows an operator to communicate the distance to the target to the bullet, as with Objective Individual Combat Weapon (OICW) and Objective Crew Served Weapon (OCSW), so that the velocity reduction mechanism is activated at the proper moment for a "soft" impact.

A power supply may provide energy to at least the communication apparatus. The power supply may include a use detection apparatus for activating the power supply after the occurrence of a use event. The use event may be chosen from the group consisting of: a launch event, and an impact event. The power supply may be an electrochemical battery pack that generates electrical energy due to an electrochemical reaction between at least two components, and the use detection apparatus may include a membrane that separates the at least two components until the occurrence of the use event.

The battery pack may be a zinc air ($Zn/0_2$) battery pack, the at least two components may include zinc, carbon and air; and the membrane may separate the zinc and carbon from the air.

The battery pack may be a lead acid ($Pb/H_2SO_4$) battery pack; the at least two components may include lead, lead oxide and sulfuric acid; and the membrane may separate the lead and lead oxide from the sulfuric acid.

The battery pack may be an alkaline battery pack; the at least two components may include zinc, manganese dioxide and potassium hydroxide; and the membrane may separate the zinc and the manganese dioxide from the potassium hydroxide.

The communication apparatus may include a reception device for receiving energy from a remote source. The energy received may be RF energy, and the reception device may include an antenna. The energy received may be infrared energy, and the reception device may include a photoreceptor. The energy received may include an encoded data signal configured to energize at least a portion of the communication apparatus. The energized portion of the communication apparatus may include a transmission device for transmitting energy to a remote receiver.

The communication apparatus may include a transmission device for transmitting energy to a remote receiver. The transmitted energy may be RF energy, and the transmission device may include an antenna. The transmitted energy may be infrared energy, and the transmission device may include one or more light emitting diode. The emitter can be visible to the naked eye and/or visible only with specialized night vision equipment, detectors or other electro-magnetic receiving means. The device can operate in several different functional modes including emission on interrogation (targeting beacon) or continuous signaling (electronic tracer).

The transmission apparatus may further include a lens assembly for refracting the infrared energy transmitted from the one or more light emitting diodes. The lens assembly may be a convex lens assembly or a concave minor assembly.

The one or more light emitting diodes may include a plurality of light emitting diodes, the transmission device may further include a driver circuit for sequentially exciting each of the one or more light emitting diodes.

The transmission apparatus may include a lens assembly configured to: project the infrared energy transmitted from a first of the plurality of light emitting diodes at a first radial angle, and project the infrared energy transmitted from a second of the plurality of light emitting diodes at a second radial angle. The transmission apparatus may include a lens assembly configured to: project the infrared energy transmitted from a first of the plurality of light emitting diodes at a first longitudinal angle, and project the infrared energy transmitted from a second of the plurality of light emitting diodes at a second longitudinal angle. The transmission apparatus may include a lens assembly configured to: project the infrared energy transmitted from a first of the plurality of light emitting diodes at a first longitudinal angle and a first radial angle, and project the infrared energy transmitted from a second of the plurality of light emitting diodes at a second longitudinal angle and a second radial angle.

The present invention is a Ballistically Delivered Target Assignment Beacon (BADTAB) that allows standoff guidance in a "fire and retreat mode". The underlying concept is to integrate an IR illumination package into a small to medium caliber projectile that is fired at a target by a shooter using fielded weapon system, e.g. a sniper rifle. Once the BADTAB bullet hits the target, the illumination package is optionally verified to be functional, and the shooter can withdraw to safety. Upon sensing a trigger signal, or after a designated time interval, the IR illumination package begins to emit infrared light into a broad cone angle in short pulses. The emission of IR light can occur from minutes to weeks later. A range of IR wavelengths are currently available including 750-950 nm, 1.30 micron and 1.55 micron (eye-safe). However, the invention applies generally to emission wavelengths ranging from the visible throughout the near IR (NIR), viz., from approximately 400 nm to 2 um.

A key consideration is the ability to detect light emitted by the BADTAB at a weapons delivery platform's location, e.g. from a bomber overhead. If using a single laser diode or LED, one or more microlenses is necessary to spread the emitted light away from the base of the BADTAB. To increase the amount of power arriving at a remote detector, an array of IR emitters and a "Fly's eye" microlens array can be used. In this configuration, each microlens directs light in a different direction and sequentially pulsing the IR emitters at a 10 Hz rate delivers 1 nW of power to any point in a 45 degree cone at a 5 km distance. Power of 1 nW is at the threshold of detection for InGaAs based detectors. A candidate power source is an Energizer No. 319 battery, which has an 18 mAhr capacity, and is small enough to fit into a 12.7 mm bullet. An alternative power sources are Lithium anode reserve batteries, which have a greater energy density and a 20 year storage life. The move to lithium could increase the lifetime above by as much as 3 times.

The communication apparatus may be a passive communication apparatus, such as a retroreflector.

The communication apparatus may be an active communication apparatus. The active communication apparatus may be configured to substantially withstand the acceleration associated with launching the projectile from a launcher and the deceleration associated with the projectile striking the target. The active communication apparatus may include one or more surface mount electronic components mounted on a shock-resistant system board. One or more interconnections may electrically couple a plurality of electronic components internal to the projectile, such that at least one interconnection is configured to allow a limited amount of relative movement between the plurality of electronic components. The active communication apparatus may include a system board for mounting one or more electronic components, such that the system board is positioned within a plane that may be essentially orthogonal to the longitudinal axis of the projectile. The communication apparatus may include an essentially planar mounting structure that is essentially orthogonal to the longitudinal axis of the projectile, such that the essentially planar mounting structure is configured to receive a system board containing one or more electronic components. An exterior surface of the projectile may be configured to engage an interior surface of a barrel from which the projectile is launched. The interior surface of the barrel may include spiral rifling that engages the exterior surface of the projectile and rotates the projectile about the longitudinal axis after launch.

According to another aspect of this disclosure, a projectile includes a communication apparatus including a transmission device for transmitting energy to a remote receiver. An ordnance portion is positioned forward of the communication apparatus and configured to partially penetrate a target such that at least a portion of the communication apparatus is remotely visible. The projectile is configured to rotate about and travel along a longitudinal axis after launch.

According to another aspect of this disclosure, a projectile includes a communication apparatus including a transmission device for transmitting energy to a remote receiver. A receiving device receives energy from a remote transmitter, and an ordnance portion is positioned forward of the communication apparatus and configured to partially penetrate a target such that at least a portion of the communication apparatus is remotely visible. The projectile is configured to rotate about and travel along a longitudinal axis after launch. One or more interconnections electrically couple a plurality of electronic components internal to the projectile, wherein at least one interconnection is configured to allow a limited amount of relative movement between the plurality of electronic components.

The details of one or more implementations are set forth in the accompanying drawings and the description below. Other features and advantages will become apparent from the description, the drawings, and the claims.

DETAILED DESCRIPTION OF THE PREFERRED EMBODIMENTS

Figure 1:
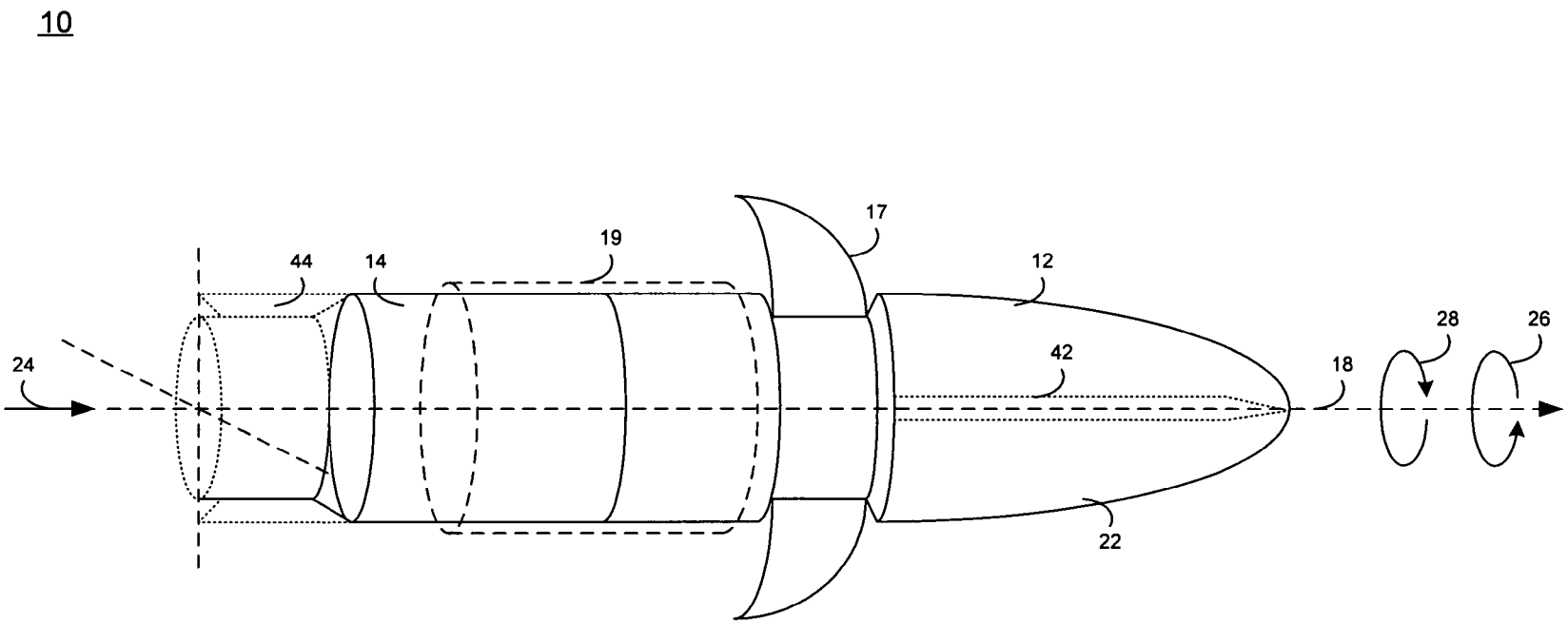
FIG. 1 is an isometric view of a projectile including an ordnance portion and a communication apparatus.
Figure 2:
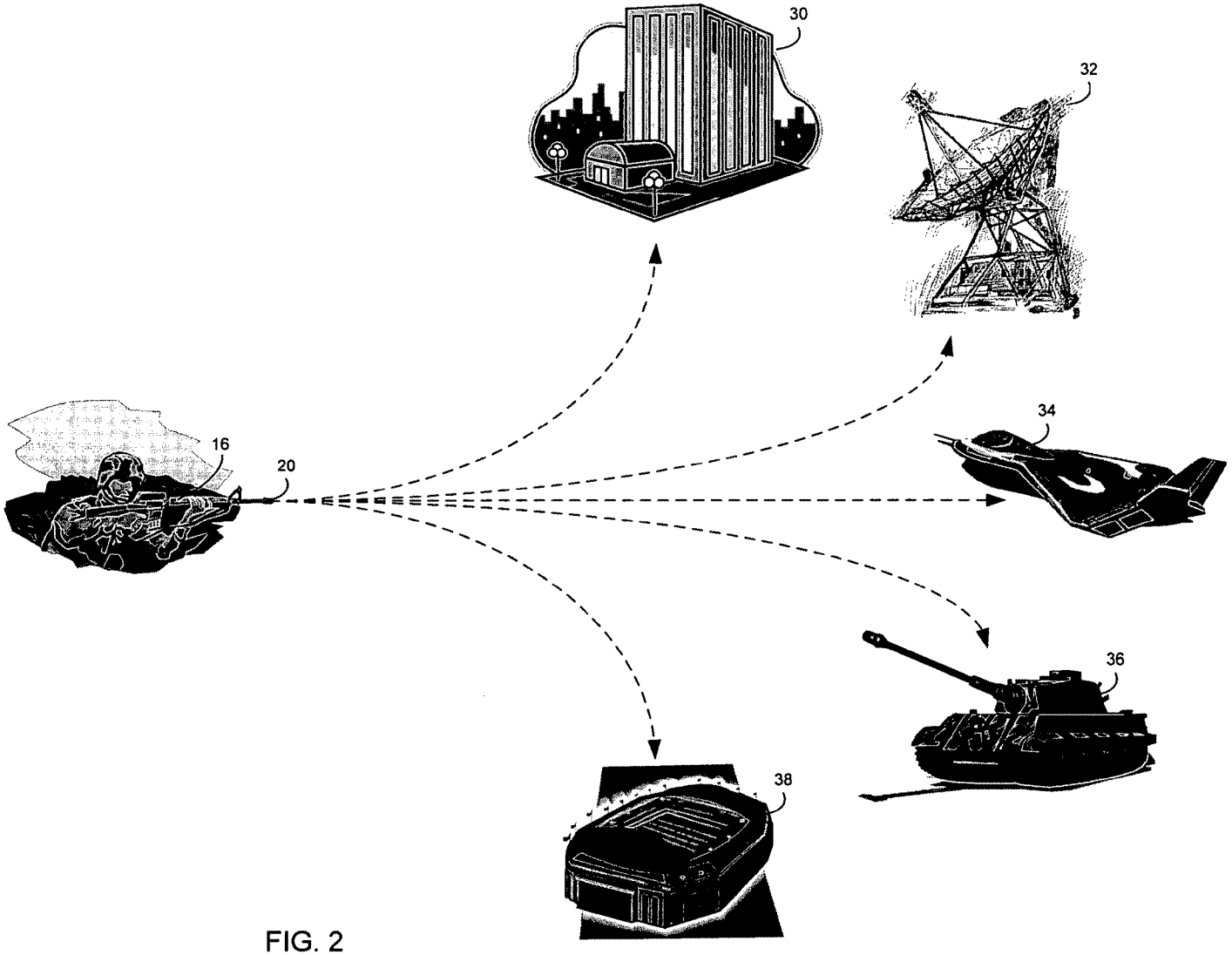
FIG. 2 is a diagrammatic view depicting the use of the projectile of FIG. 1.

Referring to FIGS. 1 and 2, there is shown a projectile 10, including an ordnance portion 12 and a communication apparatus 14, that is configured to be launched from a launcher 16 (e.g., a handgun, a rifle, or a cannon, for example). Examples of projectile 10 include a bullet, a rocket led grenade, a dart, or an artillery shell, for example. In order to facilitate stable flight, projectile 10 is configured to rotate about its longitudinal axis 18 once launched. Alternative methods for stabilizing the projectile include:

deployable fins 17 constructed out of e.g., spring steel or titanium that extend after leaving the launching barrel; or a Sabot 19 that encases the projectile and provides aerodynamic control surfaces. Typically, the rotation of projectile 10 about longitudinal axis 18 is achieved by incorporating rifling (i.e., one or more spiral grooves; not shown) into the inner surface of the barrel 20 from which projectile 10 is launched, which are engaged by the outer surface 22 of projectile 10. Accordingly, when projectile 10 is launched from launcher 16, as projectile 10 moves through barrel 20 in the direction of arrow 24, an interference fit is formed between projectile 10 and barrel 20, forcing the outer surface 22 of projectile 10 to engage the rifling on the inner surface of barrel 20, resulting in projectile 10 rotating (in the direction of either arrow 26 or arrow 28) about longitudinal axis 18.

As discussed above, projectile 10 is launched from a launcher (e.g., Barrett 82A1 sniper rifle 16) at various targets, such as: buildings 30, communications antenna 32; airplanes 34; tanks 36; and miscellaneous structures (e.g., stadium 38).

Figure 3:
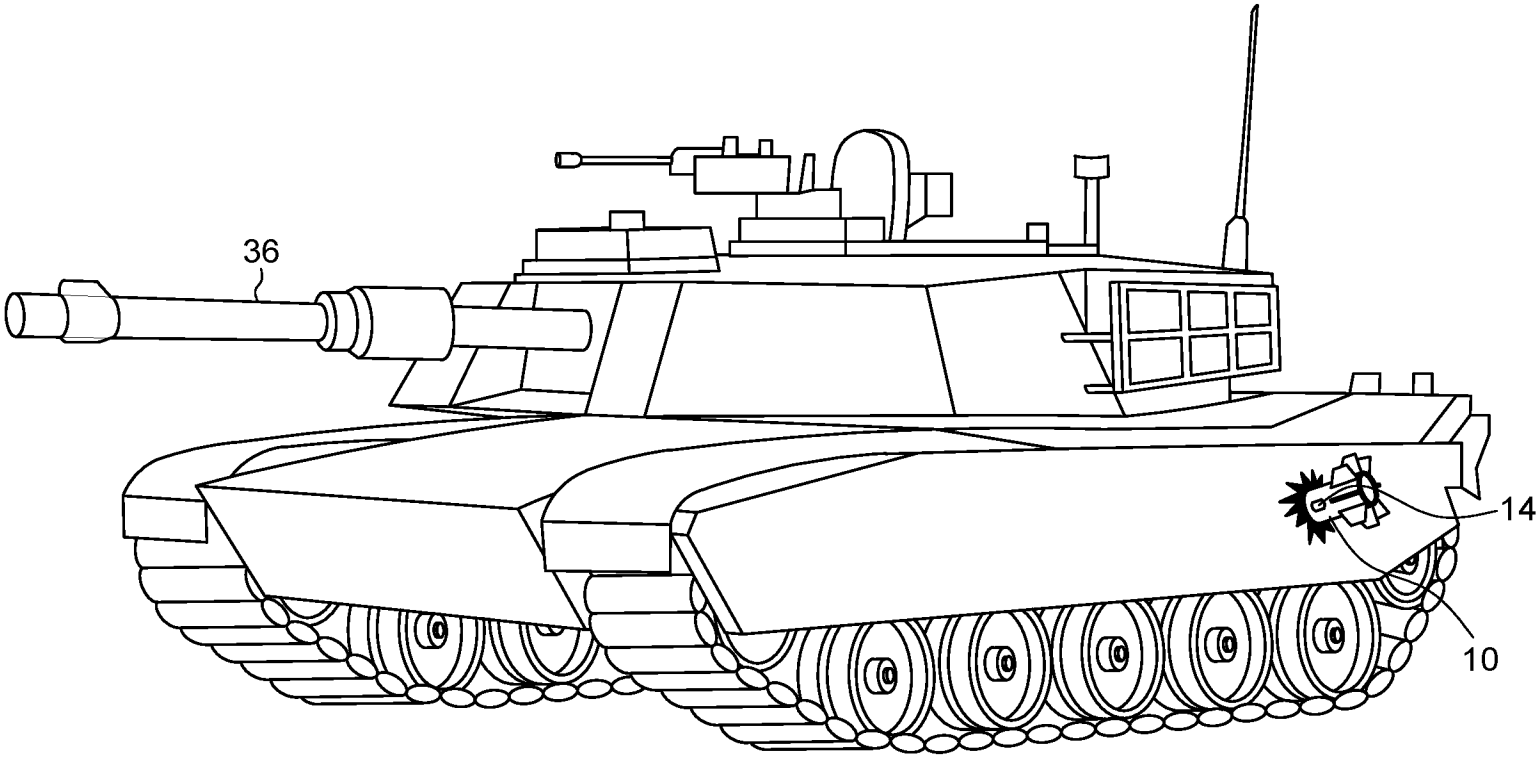
FIG. 3 is an isometric view of the projectile of FIG. 1 after deployment.

Referring also to FIG. 3, typically projectile 10 is configured to partially penetrate a target (e.g., tank 36) such that the communication apparatus 14 of projectile 10 is still visible, thus allowing projectile 10 to communicate with a remote device (to be discussed below). Concerning the structure of projectile 10, communication apparatus 14 is positioned at the rear of projectile 10 and ordnance 12 is positioned at the front of projectile 10. Accordingly, ordnance 12 absorbs the majority of the energy dissipated when projectile 10 impacts a target, thus shielding communication apparatus 14 from these potentially deforming and destructive forces.

In one embodiment the means of absorbing impact energy is a thermoplastic material that deforms on impact. In another embodiment the means of absorbing impact energy is an explosive charge or a shaped detonation projecting energy in the forward direction. For the embodiment in which the means of absorbing impact energy is an explosive charge or a shaped detonation projecting energy in the forward direction the explosion may be initiated on contact with a probe extending from the nose of the projectile.

One example of this approach uses a core of impact deformable thermoplastic that melts on impact and sticks the mushroomed bullet to the target. A variation on this approach is to use a metal (such as solder or a combination of solder with low melting point metal alloys such as Safety-Silv 45 from J. W. Harris) with a low melting point that melts on impact and causes the mushroomed bullet to adhere to the target.

In another embodiment the means of absorbing impact energy is a tip structure that includes multiple materials in structural forms capable of dissipating enough impact energy so that the beacon survives. One example of such a structure is a dense honeycomb structure sandwiched between a rigid base plate (made from titanium or steel for example) and a lead front tip.

Another way to reduce the impact velocity is to ignite a small propellant charge prior to impact. A propellant material can be provided in a tip structure that reduces the bullet's forward energy before impact.

As projectile 10 is designed to partially penetrate a target, the material from which ordnance 12 of projectile 10 is constructed varies depending on the intended target. For example, if projectile 10 is designed to imbed itself into a wooden structure (e.g., a structure in a terrorist training camp) or an aluminum structure (e.g., the vertical stabilizer of an fighter jet), the ordnance portion may be constructed of a relatively soft material, such as lead. However, if ordnance 12 is designed to imbed itself into armored plate, such as the plating used on tanks (e.g., an M1A1 tank) or armored personnel carriers (e.g., a Bradley fighting vehicle), ordnance 12 may be contracted of a sturdier material, such as depleted uranium. In other instances, the projectile is configured to attach to the surface it impacts. For example, a soft metal/thermoplastic-encased ceramic (e.g., silicon carbide), carbon fiber or hard metal (e.g., tungsten) pin 42 can be used to decelerate then affix the projectile to the target surface. The thermoplastic material can adhere the projectile to the target surface. For thinner metal surfaces (e.g., sheet metal bodies of automobiles or light trucks), a threaded screw-shaped penetration device (not shown) may be used to attach the projectile.

Additionally and as is known, the kinetic energy of an object in flight may be adjusted by varying the speed at which the object moves through the air. Accordingly, the powder charge used to propel projectile 10 into flight may be varied based on the material from which the intended target is constructed (e.g., the sturdier the target, the higher the impact velocity of the projectile). Range-limiting fins 44, as found in range-limited target ammunition (RLTA), may be utilized to control both the velocity and range of projectile 10 or cause it to fall out of flight at a predetermined distance from its launch point.

An alternative strategy is to incorporate speed control into a supersonic projectile so that the velocity can be reduced rapidly either at impact or when the projectile is close to the target. On-board speed control allows an operator to communicate the distance from the target to the bullet so that the velocity reduction mechanism is activated at the proper moment for a "soft" impact.

Figure 4:
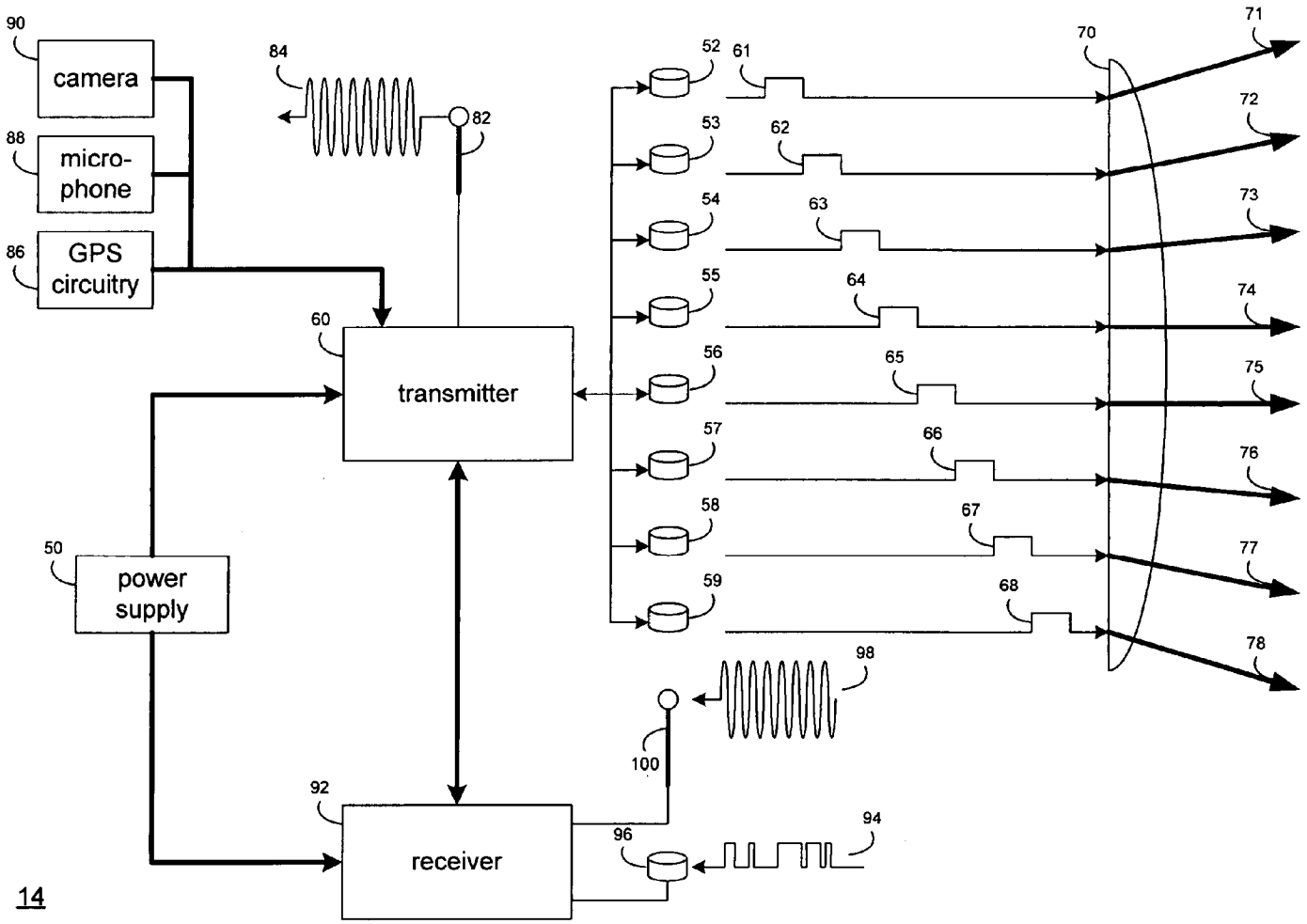
FIG. 4 is block diagram of the communication apparatus of the projectile of FIG. 1.

Referring also to FIG. 4, communication apparatus 14 includes a power supply 50 for providing power to communication apparatus 14. An example of power supply 50 is a model 4019-100 lithium battery manufactured by Electrochem Power Solutions Incorporated of Canton Mass. Depending on the type of communication to be performed by communication apparatus 14, one or more types of transmission or reception devices may be employed. For example, if communication apparatus 14 is to perform light-based communication, one or more light sources 52-59 may be employed. A typically example of light sources 52-59 is a model SMC 630 light emitting diode manufactured by Epitex Incorporated of Kyoto Japan. However, other forms of light sources, such as lasers and devices that upon impact release light from chemical reactions and/or combustion may be utilized, provided they are capable of withstanding the acceleration and deceleration experienced by projectile 10.

The light sources may be lasers or light emitting diodes that emit in the infrared, near infrared, short wave infrared, mid wave infrared or long wave infrared.

Light sources 52-59 are each driven by transmitter 60. A typical example of transmitter 60 is a PIC12FG75 manufactured by Microchip Technology Incorporated of Chandler Ariz. For light-based transmission, transmitter 60 is configured to systematically activate light sources 52-59 so that a desired light pattern is achieved.

Figure 6:
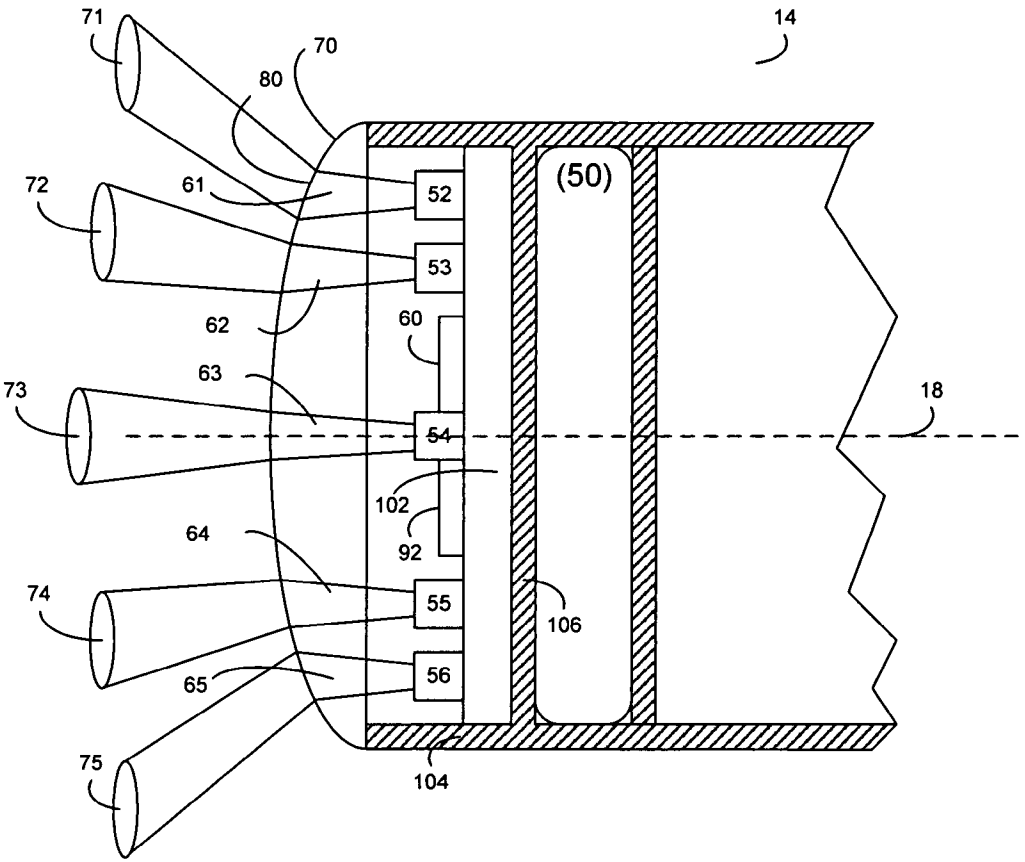
FIG. 6 is a partial cross-sectional view of the communication apparatus of the projectile of FIG. 1.
Figure 5:
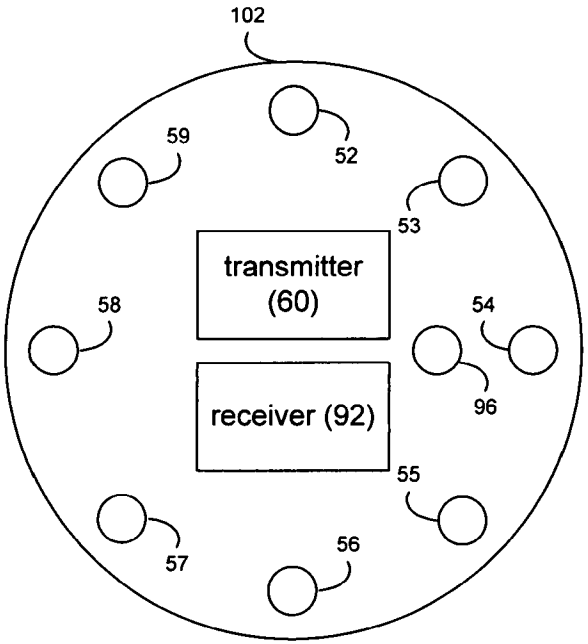
FIG. 5 is a diagrammatic view of the system board of the communication apparatus of the projectile of FIG. 1.

Referring also to FIGS. 5 and 6, light sources 52-59 are often configured in a circular pattern and light sources 52-59 are individually sequentially activated such that a sweeping light pattern is generated that repeatedly rotates about the perimeter of the circular pattern formed by the light sources. This in turn results in the generation of, in this example, eight discrete light pulses (e.g., light pulses 61-68) that are generated by light sources 52-59 respectively.

Alternatively, if enhanced illumination is desired, multiple light sources may be activated simultaneously. For example, light sources 52, 53 may be simultaneously activated, and then light source 52 may be deactivated at the same time that light source 54 is activated. Subsequently, light source 53 may be deactivated at the same time that light source 55 is activated, resulting in a sweeping light pattern in which two adjacent light sources are always activated. Alternatively still, non-adjacent light source pairs may be simultaneously activated, such as: light sources 52, 56; followed by light sources 53, 57; followed by light sources 54, 58; and so on.

Regardless of the manner in which light sources 52-59 are activated, the light pulses 61-68 (respectively) generated by light sources 52-59 are provided to a lens assembly 70, which is configured to shape the light pulses into a desired pattern. For example, if the pattern desired is a sweeping conical light pattern, a convex lens assembly 70 may be used, such that light pulses 61-68 are redirected to form diverging light pulses 71-78. Each of the diverging light pulses 71-78 is projected at a unique radial angle (with respect to the longitudinal axis 18 of projectile 10). For example, if eight light sources are evenly spaced about a circular pattern and a convex (or concave) lens assembly is used, the radial angles for diverging light pulses 71-78 would be 0°, 45°, 90°, 135°, 180°, 225°, 270°, and 315° respectively. As shown in FIG. 6, the longitudinal angle of a diverging light pulse (i.e., the angle between the longitudinal axis 18 and a diverging light pulse e.g., light pulse 71) varies based on the curvature of lens 70 and the point 80 (along the curvature) at which a light pulse (e.g., light pulse 61) strikes lens 70, such that the longitudinal angle increases as the curvature of the lens increases. Therefore, if light sources 52-59 are arranged in a linear pattern and the individual light sources are sequentially energized, the longitudinal angle of the diverging light pulses 71-78 will vary as the individual light sources are sequentially activated (as shown in FIG. 4). The light sources may be disposed radially around the perimeter of the projectile or by means of an array of reflective surfaces (mirrors), the light from the backward pointing light sources may be reflected in such as way as to direct out the sides of the projectile.

Depending on the application, light sources 52-59 are typically configured to provide light in the infrared spectrum (i.e., having a frequency of approximately $3\times10^{12}$-$4.3\times10^{14}$ Hertz); the visible spectrum (i.e., having a frequency of approximately $4.3\times10^{14}$-$7.5\times10^{14}$ Hertz), or the ultraviolet spectrum (i.e., having a frequency of approximately $7.5\times10^{14}$-$3\times10^{17}$ Hertz).

In addition to light-based communication, communication apparatus 14 may be configured for RF communication. If configured for RF communication, transmitter 60 would be configured to facilitates such communications. For example, a modulator circuit (not shown) may be incorporated into transmitter 60 so that a data signal could be modulated onto a carrier signal. Additionally, an encryption circuit (not shown) may be incorporated into transmitter 60 so that the data signal may be encrypted prior to being transmitted. Additionally, if configured for RF communication, an antenna 82 is electrically coupled to the transmitter 60 so that the modulated signal 84 can be broadcast to the remote device (not shown). Concerning the type of data broadcast, a global positioning system (GPS) device 86 may be included so that longitudinal and latitudinal location data (concerning projectile 10) can be broadcast to the remote device (not shown). Additionally, a microphone 88 and/or a video camera 90 may be included to broadcast audio data and/or video data to the remote device.

In one embodiment the electronic driver circuit is connected to a sensor for providing locally derived data to a remote observer. The sensor may be one that is capable of detecting vibration, motion, chemicals, biological agents, nuclear decay particles, sound, or electromagnetic signals or position. One embodiment may include capability for recording or integrating these sensed characteristics over time.

In addition to broadcasting data (e.g., light pulses, GPS data, audio data and/or video data), communication apparatus 14 may be configured to receive data. If configured to received data, a receiver 92 is included that allows communication apparatus 14 to receive e.g., a light-based data signal 94 via a photoreceptor 96 (coupled to receiver 92) and/or an RF-based data signal 98 via an antenna 100 (coupled to receiver 92).

As power supply 50 stores a finite amount of energy, light-based data signal 94 and/or RF-based data signal 98 may include an encoded data signal (not shown) that energizes a portion of communication apparatus 14. For example, when initially launched, communication apparatus 14 may be configured such that upon launch and impact with a target (e.g., a terrorist safe house), transmitter 60 and light sources 52-59 are disabled and only receiver 92 and photoreceptor 96 are enabled. Assume that projectile 10 is being used to illuminate the target for destruction by a laser-guided bomb, and that the light sources are LED's that provide an IR guidance signal that the laser-guided bomb uses for tracking purposes. If the terrorist safe house is not going to be destroyed for one week, at some time just prior to the attack, an RF or light-based data signal may be transmitted to communications apparatus 14 instructing communication apparatus 14 to energize transmitter 60 and light sources 52-59, thus allowing power source 50 to conserve power until the point in time when it is required to transmit the IR guidance signal (as opposed to the entire week prior to the attack). Further, as the IR guidance signal may be seen using night vision goggles, it is desirable to limit the transmission time, as transmitting the signal too early may result in projectile 10 being discovered and destroyed.

As stated above, projectile 10 is designed to partially penetrate the target at which it is shot so that communication apparatus 14 can communicate with a remote device (not shown). Therefore, communication apparatus 14 must be able to withstand the acceleration experienced by projectile 10 at the time of launch, and the deceleration experienced by projectile 10 at the time of target impact.

Accordingly, the individual components (e.g., transmitter 60) of communication apparatus 14 are typically constructed using surface-mount component technology, in which the individual components actually make contact with and are soldered to the system board 102 with flexible conductive epoxy and inherently flexible solders. Therefore, there is very little gap between the lower surface of the component and the upper surface of the system board, and the likelihood of damaging the component and/or connections between the component and the system board (when the projectile is launched and/or impacts the target) is reduced because the components are allowed a certain amount of movement upon impact. Further, system board 102 may be constructed of a resilient material (e.g., fiberglass reinforced plastic) that is less prone to shattering and/or fracturing. Component to component wiring and component to board wiring, other than the surface mounted attachments, is accomplished using loops of malleable gold wire and ultrasonic welded "wedge type" wire bonds. After surface mount and wire bonding the entire circuit is encapsulated in a semiflexible epoxy such as Summers Optical P-92.

Additionally, system board 102 is typically positioned such that the plane of the system board 102 is orthogonal to the longitudinal axis 18 of projectile 10. Typically, the housing 104 of communication apparatus 14 includes a mounting structure 106 (that is orthogonal to the longitudinal axis 18 of projectile 10) onto which system board 102 is mounted. Typically, system board 102 is constructed such that the lower surface of system board 102 is flat, thus allowing the lower surface of the system board 102 to make contact with mounting structure 106 (thus eliminating any gaps between system board 102 and mounting structure 106.

Actual construction of the electronics portion of the IR beacon is done using g-hardened multichip module techniques. The use of IR lasers and integrated circuits in chip form minimizes assembly size. These circuit elements are stacked, bonded, and edge-connected to minimize metal interconnect lengths and to reduce overall package volume. Rigid polymers surrounding this assembly enhance mechanical stability. Proper chip layout, battery location and assembly within the IR beacon ensures gyroscopic stability for optimum trajectory.

Figure 7:
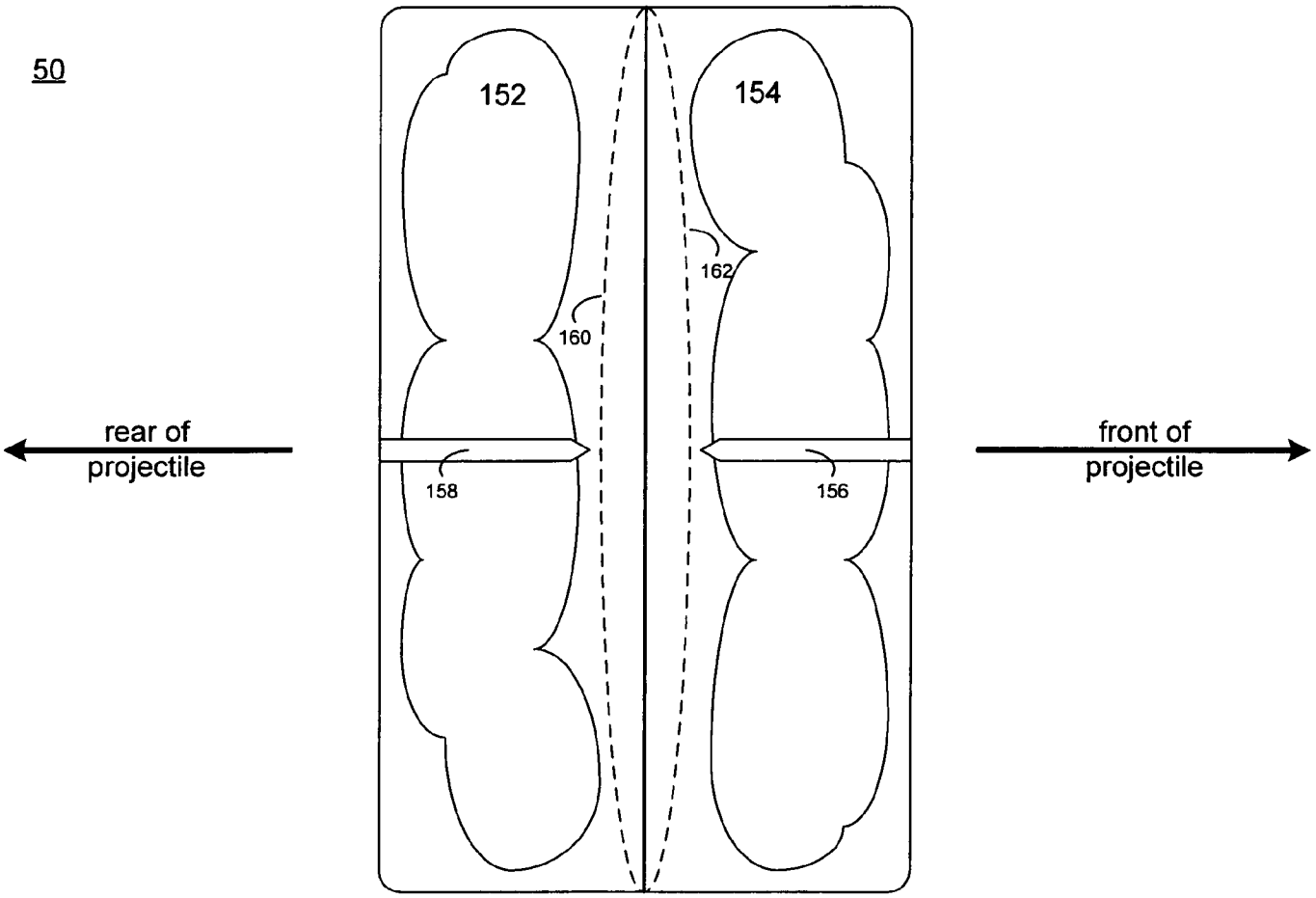
FIG. 7 is a diagrammatic view of the power supply of the communication apparatus of the projectile of FIG. 1.
Figure 8:
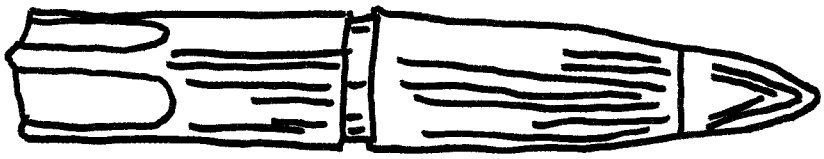
FIG. 8 is a three dimensional view of the Olin's range limited training ammunition (RLTA) showing the fins that slow it down or stop it in mid-flight.

Referring also to FIG. 7, in order to enhance the shelf life of power supply 50 within projectile 10, power supply 50 typically includes a use detection apparatus 150 for activating the power supply after the occurrence of a use event (e.g., projectile 10 being launched at a target or projectile 10 striking a target).

Typically, power supply 50 is a battery pack that generates electricity due to an electrochemical reaction between at least two components 152, 154. Use detection apparatus 150 may be a membrane that separates the two components until the occurrence of the use event, at which point the membrane ruptures and the electrochemical reaction begins and electricity is generated. For example, membrane 150 may be constructed of Mylar and positioned between two pins 156, 158, one pin 156 being positioned toward the front of projectile 10 and the other pin 158 being positioned toward the rear of projectile 10. Accordingly, during an acceleration event (i.e., a launch), membrane 150 is deflected rearward (into position 160), striking pin 158, rupturing membrane 150 and allowing the various components 152, 154 of power supply 50 to interact. Alternatively, during a deceleration event (i.e., the projecting striking a target), membrane 150 is deflected frontward (into position 162), striking pin 156, rupturing membrane 150 and allowing the various components 152, 154 of power supply 50 to interact.

Typical examples of power supply 50 include a zinc air ($Zn/0_2$) battery pack, in which the components separated by membrane 150 include zinc, carbon and air, such that electricity is generated due to an electrochemical reaction between the zinc/carbon and the air.

Another example of power supply 50 includes a lead acid ($Pb/H_2SO_4$) battery pack, in which the components separated by membrane 150 include lead, lead oxide and sulfuric acid, such that electricity is generated due to an electrochemical reaction between the lead/lead oxide and the sulfuric acid.

Additionally, power supply 50 may be an alkaline battery pack, in which the components separated by membrane 150 include zinc, manganese dioxide and potassium hydroxide, such that electricity is generated due to a electrochemical reaction between the zinc/manganese dioxide and the potassium hydroxide.

While power supply 50 is described above as including a membrane that is ruptured by striking one or more pins, other configurations are possible. For example, membrane 150 may be configured such that the membrane is incapable of withstanding the gravitational load of projectile launch and/or target strike and, therefore, ruptures upon the occurrence of one of these events without striking a pin or any other device. Alternatively, a normally-closed microswitch might be incorporated into power supply 150 that, upon the occurrence of a use event (i.e., a launch or an impact), the microswitch is closed and the communication apparatus is energized.

While the system is described above a being configured such that a sweeping light pattern is generated that follows a circular pattern, other configurations are possible. For example, all of light sources 52-59 may be configured (via transmitter 60) to be simultaneously activated and deactivated. Further, light sources 52-59 need not be configured in a circular pattern, as other configurations are possible. For example, light sources 52-59 may be configured in a square, rectangular, linear, x-shaped, or triangular pattern.

While the system is described above as including an active communication apparatus, a passive communication apparatus may also be employed. For example, communication apparatus 14 may include a non-powered retroreflector (not shown) that reflects an external light source that is used to illuminate the retroreflector. For example, the external light source may be a laser light source that is configured to strike the retroreflector (i.e., the passive communication apparatus), such that a portion of the laser light is reflected to an external device (e.g., the laser guidance system of a missile or smart bomb). In one embodiment a material with a reflective property that can be remotely interrogated, i.e. chemo-optic sensors is used. As with the active communication apparatus described above, the passive communication apparatus must be designed to withstand the acceleration and deceleration experienced by projectile 10.

Non-projectile versions of the above devices that are used for target marking may be delivered to the target by other means, such as by hand placement, air-drop, remotely piloted vehicle, robot, remote controlled device, or a non-human living creature.

A number of implementations have been described. Nevertheless, it will be understood that various modifications may be made. Accordingly, other implementations are within the scope of the following claims.

What is claimed is:

1. A system for communicating with a projectile in flight toward an intended target, comprising a barrel-launched projectile and a remote receiver, wherein said barrel-launched projectile includes an ordnance portion, an active communications apparatus and an onboard speed control, wherein said active communications apparatus includes an onboard receiver, an electromagnetic wave reception device, and an active transmitter, wherein said electromagnetic wave reception device includes at least one from the group consisting of an antenna and a photo receptor and is configured to receive an electromagnetic signal, wherein said electromagnetic wave reception device is connected to provide a signal derived from said electromagnetic signal to said onboard receiver to deploy said onboard speed control, wherein said active transmitter is connected and configured for transmitting a signal to said remote receiver during flight and before activation of said speed control, wherein said transmitted signal is directed within a cone angle extending in a direction opposite of said barrel-launched projectile's flight direction, wherein said onboard speed control includes a shaped explosive charge, wherein said deploying said onboard speed control initiates explosion of said shaped explosive charge, wherein said explosion of said shaped explosive charge adjusts velocity of said barrel-launched projectile.

2. The projectile of claim 1, wherein said active transmitter includes a light source.

3. The projectile of claim 2, wherein light provided by said light source is infrared.

4. The projectile of claim 2, wherein said communications apparatus further includes a lens assembly positioned for refracting said light.

5. The projectile of claim 2, wherein said light source includes at least one from the group consisting of an LED, a laser, a chemical reaction and combustion.

6. The projectile of claim 5, further comprising a plurality of said light sources, and wherein said communications apparatus further includes a driver circuit for sequentially exciting each of said light sources.

7. The projectile of claim 6, wherein said communications apparatus further includes a lens assembly configured to project said light transmitted from a first of said plurality of light sources at a first radial angle and to project said infrared energy transmitted from a second of said plurality of light sources at a second radial angle.

8. The projectile of claim 6, wherein said communications apparatus further includes a lens assembly configured to project said light transmitted from a first of said plurality of light sources at a first longitudinal angle and to project said light transmitted from a second of said plurality of light sources at a second longitudinal angle.

9. The projectile of claim 6, wherein said communications apparatus further includes a lens assembly configured to project said light transmitted from a first of said plurality of light sources at a first longitudinal angle and a first radial angle and to project said light transmitted from a second of said plurality of light sources at a second longitudinal angle and a second radial angle.

10. The projectile of claim 1, wherein said ordnance portion and said communications apparatus are arranged so said ordnance portion extends in the direction of flight ahead of said communications portion so said ordnance portion is first to impact the target, wherein said shaped charge is configured to reduce enough of the energy of impact with the target to protect said communications apparatus from damage during the impact while leaving sufficient remaining energy for attachment of said communications apparatus to the target.

11. The projectile of claim 10, wherein said communications apparatus is structured to substantially withstand said remaining energy of the impact so said communications apparatus can communicate after the impact.

12. The projectile of claim 10, wherein said remaining energy for attachment is sufficient to provide attachment based on at least one from the group consisting of partial penetration into the target and melt of a part of said ordnance portion on impact, where said melt of a part of said ordnance portion is for facilitating said attachment to the target.

13. The projectile of claim 10, wherein said ordnance portion is configured so in said attachment at least a portion of the communication apparatus is remotely visible after said partially penetrating attachment.

14. The projectile of claim 1, further comprising a system board mounted within a plane that is essentially orthogonal to said direction of flight.

15. The projectile of claim 14, further comprising an essentially planar mounting structure that is essentially orthogonal to said direction of flight, wherein said essentially planar mounting structure is configured to receive said system board.

16. The projectile of claim 1, wherein said active communication apparatus includes one or more surface mount electronic components mounted on a shock-resistant system board.

17. The projectile of claim 1, further comprising electrical components and an electrical interconnection there between, wherein said electrical interconnection is configured to allow relative movement between said electrical components.

18. The projectile of claim 1, further comprising a power supply for providing energy to at least said communication apparatus.

19. The projectile of claim 1, wherein said active transmitter includes an antenna and wherein transmitted energy includes RF energy.

20. The projectile of claim 1, further comprising a sensor.

21. The projectile of claim 20, wherein said sensor is capable of detecting at least one from the group consisting of vibration, motion, chemicals, biological agents, nuclear decay particles, sound, or electromagnetic signals and position.

22. The projectile of claim 20, further comprising a sensor data recorder.

23. The projectile of claim 1, wherein said transmitter includes an electronic tracer.

* * * * *